United States Patent [19]

Kropf

[11] 4,019,605

[45] Apr. 26, 1977

[54] FOOD DELIVERY SYSTEM FOR RESTAURANTS

[76] Inventor: Frederic F. Kropf, 2419 N. 72nd Place, Kansas City, Kans. 66109

[22] Filed: Aug. 23, 1976

[21] Appl. No.: 716,466

[52] U.S. Cl. ..... 186/1 R; 104/127; 186/22; 198/367; 198/484; 198/678

[51] Int. Cl.[2] ..... E04H 3/04

[58] Field of Search ..... 186/1 R, 1 C, 1 B, 1 D, 186/17, 18, 22, 23, 2, 3, 8; 214/11 R; 104/127; 198/367, 483, 484, 678

[56] References Cited

UNITED STATES PATENTS

| | | | |
|---|---|---|---|
| 559,095 | 4/1896 | Bostedo | 186/22 |
| 1,606,627 | 11/1926 | Gromer | 186/1 R |

*Primary Examiner*—Trygve M. Blix
*Assistant Examiner*—Rheinhard J. Eisenzopf
*Attorney, Agent, or Firm*—John A. Hamilton

[57] ABSTRACT

In a food delivery system for restaurants, a conveyor tray adapted to receive a food container and to move along an overhead conveyor track from a central station along a loop including a series of delivery stations at patrons tables, an elevator including an elevator tray at each of the stations, trip mechanism at each station operable when actuated to remove the food container from the conveyor tray to the elevator tray at the station, the trip mechanisms being selectively actuated from a central location, mechanism operable by the reception of the food container on the elevator tray to lower said elevator tray to a position within reach of the patron, and to reset the trip mechanism, and mechanism operable by removal of the food container from the elevator tray to re-elevate the tray into operative relation with the conveyor.

12 Claims, 9 Drawing Figures

III
38
44
54
62
64
42
40
46
52
60
170
2
172
166
168
154
156
152
148
164
158
128
150
146
138
142
112
130
182
186
136
132
126
34
36
32
94
134
78
80
98
82
100
50
88
90
68
72
74
58
96
66
102
20
14
160
176
174
178
180
184
162

FOOD DELIVERY SYSTEM FOR RESTAURANTS

This invention relates to new and useful improvements in food delivery systems for restaurants, and has particular reference to a system operable to deliver said food from a central station, such as the restaurant kitchen, selectively to any one of a large number of delivery stations, which are usually the individual tables at which the patrons are seated, without requiring the services of waiters or waitresses. The system of course effects substantial savings in salaries of the waiters and waitresses, and greatly reduces the often congested traffic of waitresses with loaded trays in the public areas of restaurants. Although not per se a part of the present invention, it will be readily apparent that the patrons' orders may be transmitted to a central location by telephone or intercom transmitters mounted at each table.

Generally, the above general object is accomplished by the use of a conveyor track arranged in an endless loop extending from a central location, such as the restaurant kitchen, past any desired number of delivery stations, each at a patron's table. Movable along the track is a carriage including a tray on which a food container may be placed. At each delivery station is disposed an elevator mechanism including an elevator tray normally disposed at an elevation just below that of the conveyor tray, and a trip member which, when properly positioned by an operator at the central location, will move the food container from the conveyor tray to the elevator tray as the conveyor carriage passes that station. The elevator then lowers the elevator tray to an elevation within easy reach of the patron, who then removes the food container, the elevator tray then being re-elevated to its normal position relative to the conveyor. Preferably, the lowering and raising of the elevator tray is accomplished automatically, in response respectively to the placing of the food container thereon, and the removal of the food container therefrom. Also, resetting of the trip member is accomplished automatically by movement of the elevator.

Other objects are simplicity and economy of construction, convenience, efficiency, and dependability of operation, and adaptability for use in a wide variety of product-delivery operations.

Figure 1:
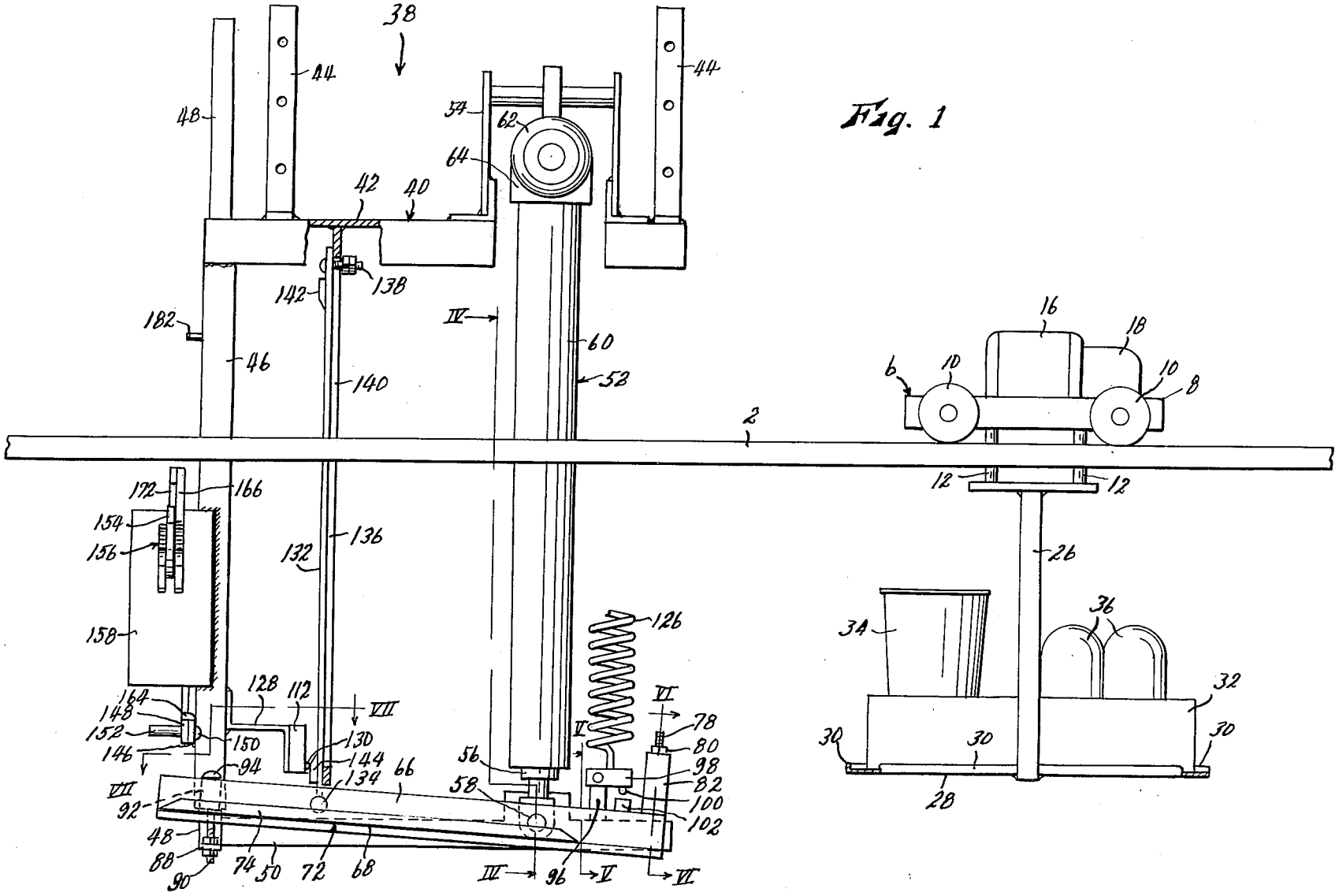
Figures 2, 3:
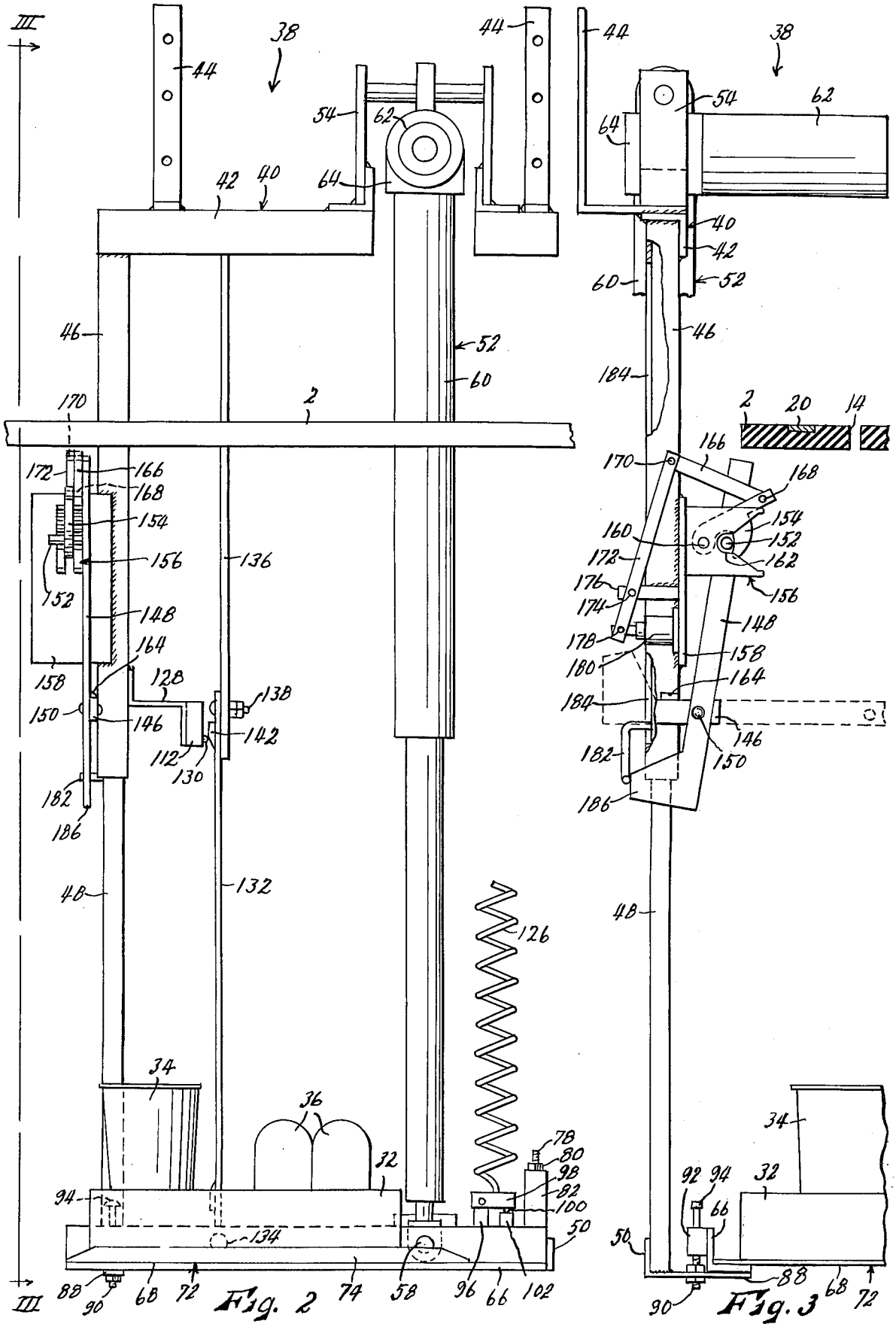
Figure 4:
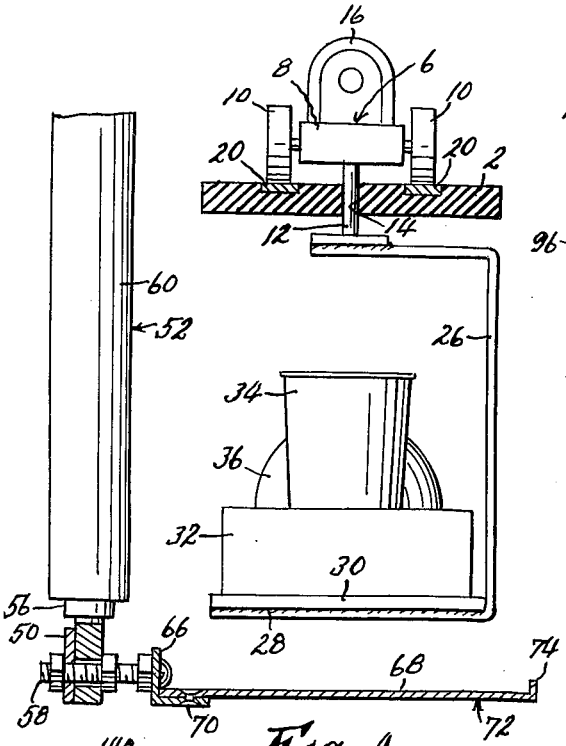
Figure 5:
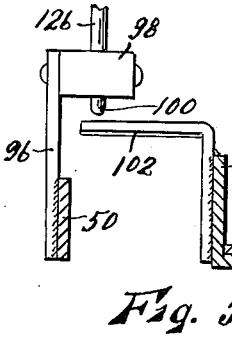
Figure 6:
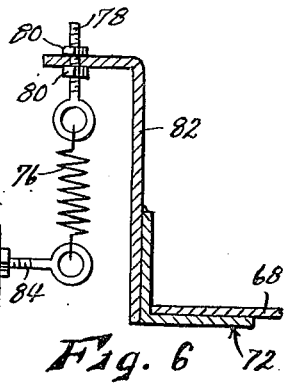
Figure 7:
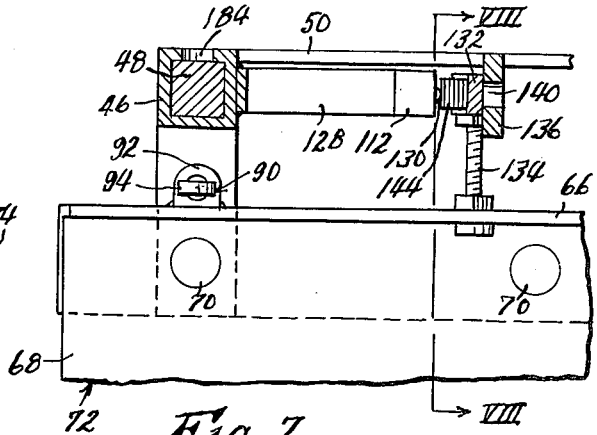
Figure 8:
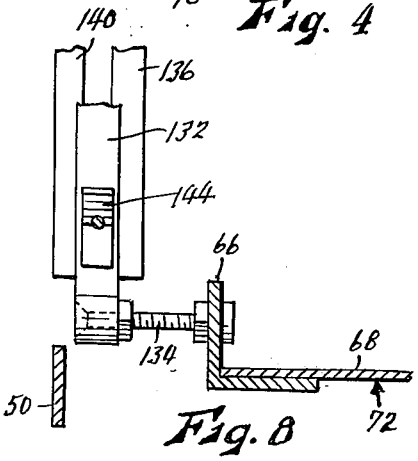
Figure 9:
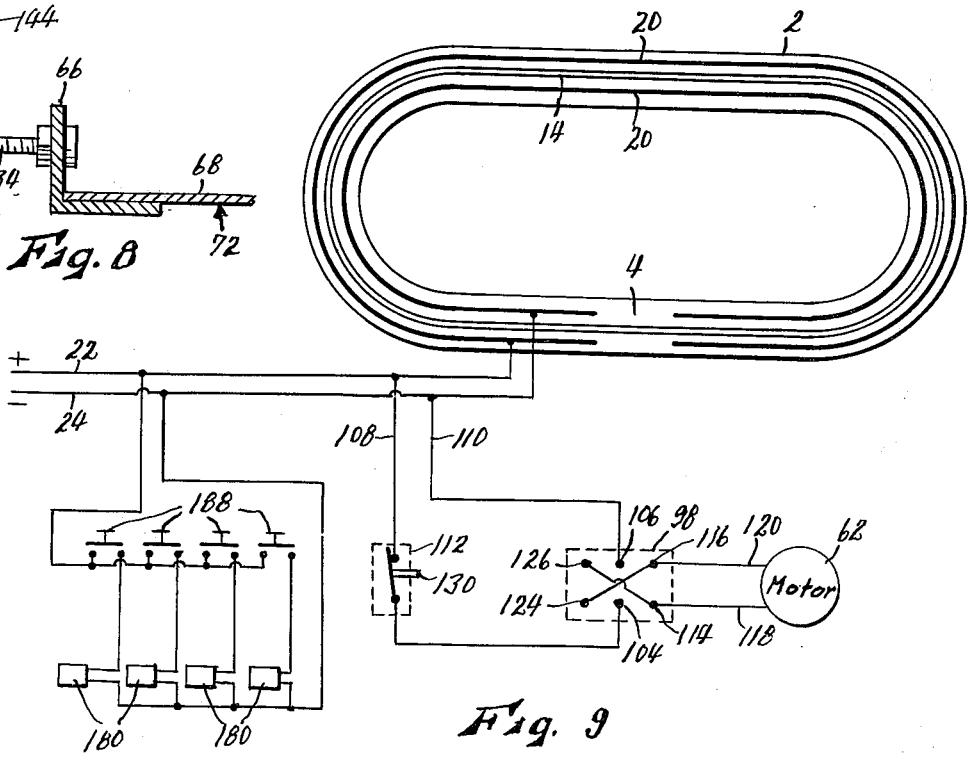

With these objects in view, as well as other objects which will appear in the course of the specification, reference will be had to the accompanying drawing, wherein:

FIG. 1 is a side elevational view of one of the delivery stations of a food delivery system embodying the present invention, the conveyor track being shown fragmentarily, and with a conveyor carriage approaching said delivery station, FIG. 2 is a view similar to FIG. 1, but with the food container transferred from the conveyor tray to the elevator tray, and lowered to the lower limit of its travel, FIG. 3 is a fragmentary sectional view taken on line III—III of FIG. 2, with parts broken away, FIG. 4 is a fragmentary sectional view taken on line IV—IV of FIG. 1, FIG. 5 is an enlarged, fragmentary sectional view taken on line V—V of FIG. 1, FIG. 6 is an enlarged, fragmentary sectional view taken on line VI—VI of FIG. 1, FIG. 7 is an enlarged, fragmentary sectional view taken on line VII—VII of FIG. 1, FIG. 8 is a fragmentary sectional view taken on line VIII—VIII of FIG. 7, and FIG. 9 is a schematic wiring diagram of the system.

Like reference numerals apply to similar parts throughout the several views, and the numeral 2 applies to a conveyor track, which may have the form of a flat board, and which, as indicated in FIG. 9, has the form of an endless loop, being supported in a horizontal position by any suitable means, not shown, to extend from a central station 4, around the public area of a restaurant, and back to the central station 4. It is of course disposed in a sufficiently overhead position, and also preferably sufficiently close to the room walls, that it does not interfere with normal traffic in the area.

Carried for movement along track 2 are any desired number of carriages 6. Each carriage (see FIG. 1) includes a body member 8 supported above track 2 by rotatable track-engaging wheels 10, and guided for movement along said track by posts 12 affixed thereto and depending through a slot 14 formed centrally in the track and extending the full length thereof. Each carriage is driven by an electric motor 16 mounted on body 8 thereof and having a driving connection 18, such as a reducing gear drive, to certain of wheels 10 thereof, say the rear pair of said wheels. Another pair of said wheels, say the front pair, are formed of electrical conducting material, and have rolling contact with a pair of contact strips 20 set into the surface of track 2 respectively at opposite sides of slot 20 thereof, whereby electric current for driving motor 16 is supplied.

Electric line wires 22 and 24 are connected respectively to contact strips 20, as shown in FIG. 9. Said contact strips are continuous except at central station 4, where they are interrupted as shown, so that any carriage 6 entering this portion of the track will come to rest. The interruption may be of sufficient length to accomodate any desired number of carriages. Affixed to the lower ends of posts 12 of each carriage, beneath track 2, is an arm 26 which is first offset laterally toward one side of the track, then extends downwardly, then turned to extend laterally beneath the track, having an upwardly facing horizontal tray 28 affixed to its lower end portion. Said conveyor tray is preferably laterally centered beneath track 2, and may have raised lips 30 at its side edges and at its forward edge (the left edge as viewed in FIG. 1), but not at its rearward edge (the right edge as viewed in FIG. 1). A food container 32 may be placed on tray 28. Although it may be of any suitable type, it is preferably of the single-use, disposable type usually formed of cardboard or plastic, and may contain soft drink cups 34, wrapped sandwiches 36, or other food items. The container 32 is loaded and placed on conveyor tray 28 while the associated carriage 6 is at central station 4 of the conveyor. Said carriage may then be manually pushed along the track until its conductor wheels engage contact strips 20, whereupon the carriage will be driven around the entire circumference of the track by its motor 16.

As each carriage 6 passes around track 2, it passes, in sequence, any desired number of delivery stations 38, all of which are identical, and one of which is detailed in FIGS. 1–8. Each delivery station is at a patron's table, and includes a frame 40 comprising a top angle iron 42 which is horizontal and which may be affixed to a room wall in parallel, outwardly spaced relation therefrom by means of brackets 44 affixed thereto, and a vertical tube 46, square in cross-sectional contour as shown, affixed to and depending from the forward end of said angle iron, having reference to the direction of carriage travel. This is the left end of the angle iron as viewed in FIG. 1. A vertical leg 48 is telescoped slidably in tube 46, and projects at all times below the lower end of said tube. A lower bar 50 disposed below and parallel to angle iron 42, is fixed at one end to the lower end of leg 48. A vertical mechanical actuator 52 is connected at its upper end to angle iron 42, rearwardly of tube 46, by means of bracket 54, and the downwardly extending plunger 56 of said actuator is affixed to lower bar 50 by means of bolt 58, as best shown in FIG. 4. Said actuator is of a common type, the details of which are not considered pertinent to the present invention. Generally, it includes a cylindrical, elongated housing 60 in which plunger 56 moves in the manner of a piston, the housing having a reversible electric motor 62 mounted at its upper end which is operable through a suitable drive train, usually of the gear and screw type, carried in a housing 64 also affixed to housing 60, to extend plunger 56 when the motor is operated in one direction, and to retract the plunger when the motor is operated in the opposite direction. Of course, as the plunger is extended or retracted, bar 50 is correspondingly lowered or raised by sliding leg 48 in tube 46. Bar 50 serves as a mount for the elevator tray to be described. Tube 46 and actuator 52 extend vertically at one side of track 2, preferably between said track and the wall on which brackets 44 are mounted.

Bolt 58 extends horizontally toward track 2, and an angle iron 66 is pivoted intermediate its ends on said bolt. Said angle iron is generally coextensive with lower bar 50 of the frame, and their vertical planes are parallel. A flat plate 68 is fixed at one edge to angle iron 66 by rivets 70 and extends outwardly therefrom to form in conjunction with said angle iron, an elevator tray designated generally by the numeral 72. Said elevator tray is generally rectangular, is generally transversely centered beneath track 2, and is somewhat wider and longer than conveyor tray 28. It may be provided at its outer side edge with an upturned lip 74. The elevator tray is generally horizontal, except that its forward edge may pivot upwardly to a slight degree, being biased upwardly by a vertical tension spring 76 at its rearward end, behind bolt 58, as shown in FIG. 6. Said spring is engaged at its upper end in an eye-bolt 78 adjustably mounted by nuts 80 in an arm 82 affixed to angle arm 66 of the elevator tray, and is engaged at its lower end in an eye-bolt 84 fixed by nuts 86 in lower bar 50, whereby to bias the forward edge of the elevator tray upwardly. Eye-bolt 78 may be adjusted to a tension sufficient to raise the forward edge of the tray whenever the tray is empty, but to permit the tray to be lowered by the minimum weight of a food container 32 deposited thereon. The downward movement of the tray is limited to a horizontal position by a horizontal stop arm 88 affixed to the lower end of leg 48 and extending outwardly therefrom beneath the tray. A bolt 90 is affixed in arm 88 and extends upwardly therefrom adjacent angle iron 66, passing through a loosely fitting keeper 92 fixed to said angle iron, and having an enlarged head 94 above said keeper. The abutment of said keeper against head 94 limits the upward pivotal movement of the tray.

Affixed to the rearward end portion of bar 50, between bolt 58 and spring 76, is an arm 96 on which is mounted a motor reversing switch 98 which controls motor 62. Said switch has an operating button 100 operable by an arm 102 affixed to the adjacent portion of angle iron 66 of tray 72, so as to be depressed whenever said tray is pivoted downwardly against stop arm 88, and to be released whenever said tray is pivoted upwardly against stop bolt head 94. Referring to FIG. 9, it will be seen that switch 98 is of a double-pole, double-throw type, to the central contacts 104 and 106 of which current is furnished from line wires 22 and 24 by wires 108 and 110, through an on-off switch 112 to be described. When control button 100 of switch 98 is depressed, its contacts 104 and 106 are connected to contacts 114 and 116 to supply current to motor 62 through wires 118 and 120 to operate said motor in a direction to extend actuator 52 to lower tray 72. When button 100 is released, contacts 104 and 106 are connected to contacts 122 and 124, which supply current of reversed polarity to motor 62 to cause a reverse operation thereof to retract actuator 52 to raise tray 72, said motor being of a type the rotation of which is reversed by a reversal of polarity of its operating electric current. Since switch 98 is mounted on a vertically movable portion of the elevator, the electrical lead wires thereto may be carried in a spring-coil cable 126.

Affixed on frame tube 46, adjacent the lower end thereof, is a bracket 128 on which on-off switch 112 is mounted. Said switch is of a normally closed type, remaining closed at all times except when its operating button 130 is depressed. A switch operating bar 132 is pivoted at its lower end to angle iron 66 of elevator tray 72 on a horizontal transverse axis as by bolt 134 (see FIGS. 7 and 8), bolt 134 being spaced apart forwardly from tray mounting bolt 58. Bar 132 has a length greater than the vertical stroke of actuator 52, and it moves in sliding engagement with a guide bar 136 fixed at its upper end to top angle iron 42 of frame 40, a bolt 138 fixed in the upper end of bar 132 being movable in a slot 140 formed in bar 136. Affixed to the face of bar 132 confronting switch 112 are a pair of vertically spaced apart wedges 142 and 144, each adapted by vertical movement of tray 72 to engage operating button 130 of switch 112 to open said switch. The effective vertical spacing between said wedges determines the vertical stroke of actuator 52. FIG. 1 shows tray 72 in its fully elevated position, and FIG. 2 shows said tray in its fully lowered position.

Fixed to tube 46, adjacent its lower end, is a horizontal arm 146 extending outwardly toward track 2. A trip arm 148 is pivoted intermediate its ends, as at 150, to the extended portion of arm 146, for movement between a horizontal position, as shown in dotted lines in FIG. 3, in which it extends horizontally outwardly above the elevated position of elevator tray 72, and also above the elevation of conveyor tray 28, as indicated in FIG. 1, and an elevated position substantially at one side of track 2, as shown in solid lines in FIG. 3. Said trip arm has a pin 152 affixed thereto in parallel, spaced apart relation from pivot 150, said pin, as the trip arm is raised, deflecting the latch lever 154 of a mechanical latch device 156 mounted on a plate 158 also affixed to tube 46. As best shown in FIG. 3, lever 154 is pivoted at 160, and is cammed upwardly by pin 152 as the trip arm is elevated to allow pin 152 to enter a notch 162 of the device, lever 154 falling back into place by gravity to secure said pin in said notch. This is the inoperative position of the trip arm. Whenever the latch is released, the trip arm falls to its horizontal position, which its operative position, by gravity, its downward movement being limited by a stop 164 formed by arm 146.

Latch 156 is released by a mechanism including a link 166 pivoted at one end, as at 168, to the free end of latch lever 154, extending outwardly over the top edge of plate 158, and pivoted at its opposite end, as at 170, to the upper end of an operating lever 72 disposed outwardly of plate 158, and pivoted intermediate its ends, as at 174, to an outwardly extending arm 176 fixed to plate 158. The lower end of lever 172 is pivoted, as at 178, to the armature of an electric solenoid 180 also mounted on plate 158. Thus, each time solenoid 180 is momentarily energized, it releases latch 156 to allow trip arm 148 to fall to its horizontal operative position. The trip arm is elevated to its inoperative, latched position each time actuator 52 is extended to lower elevator tray 72, by a rod 182 affixed to elevator leg 48 and movable in a slot 184 formed longitudinally in the outer side of elevator tube 46. If latch 156 has been released to move trip arm 148 to its operative position, and the elevator is lowered, rod 182 engages a portion 186 of said trip lever extending outwardly from pivot 150, and moves it downwardly to elevate the inwardly extending portion of said trip arm to engage its pin 152 in latch 156. It must be engaged in the latch before or as the elevator reaches its fully lowered position.

The solenoids 180 of the various delivery stations 38 are, as indicated in FIG. 9, connected in parallel across electric line wires 22 and 24, each in an electrically independent circuit controlled by a normally open push-button switch 188, so that whenever any of said switches are momentarily pressed, the corresponding solenoid 180 will be energized. Pushbuttons 188 may be disposed in a control panel convenient to an operator at central control station 4 of conveyor track 2.

In operation, the food ordered by patrons at any of delivery stations 38 by phone, intercom or otherwise having been prepared, an operator at central station 4 of track 2 places said food in a container 32, places said container on the tray 28 of one of carriages 6, presses the pushbutton 188 corresponding to the station 38 to which that food is to be delivered, and starts said carriage in its travel along track 2 as previously described. As will appear, at this time all of the mechanisms at each station 38 will have the position shown in FIG. 1, with actuator 52 fully retracted to raise elevator tray 72 to its maximum elevation, tray 72 tilted upwardly and forwardly by spring 76 as far as permitted by head 94 of stop screw 90, and with trip arm 148 secured in its raised, inoperative position by latch device 156, except at the particular station 38 to which the food on the then moving carriage is to be delivered. At that station, the trip arm 148 will have fallen to its horizontal operative position, as shown in FIG. 1 and in dotted lines in FIG. 3, as previously described, since latch 156 will have been released by the actuation of the corresponding solenoid 180 by the depression of the corresponding pushbutton 188.

As the moving carriage 6 passes each delivery station 38 at which trip arm 148 is inoperative it will be seen from a consideration of FIG. 1 that conveyor tray 28 passes closely above elevator tray 72 without touching it. The conveyor tray also passes beneath the level of trip arm 148, and would not engage it even if said arm were in its lowered operative position. However, the trip arm, when in its operative position, is spaced closely above the path of the conveyor, so that when carriage 6 arrives at the station 38 to which its food load is to be delivered, the food container 32 on tray 28 engages trip arm 148 thereof, which at that station is in its operative position, and its forward movement arrested by said arm, while tray 28 continues its forward movement, sliding out from under the container, and allowing said container to drop the short distance to elevator tray 72.

The weight of container 32 thus received on elevator tray 72 causes said tray to tilt downwardly to a horizontal position against stop 88. The tension of spring 76 may be adjusted so that the tray will always be tilted upwardly when empty, but will be tilted downwardly by the minimum weight of a container 32 carrying food. The downward tilting of the tray lowers operating bar 132 and disengages wedge 144 from operating button 130 of switch 112, thus closing said switch to complete the circuit of actuator motor 62, while arm 102 of the tray engages operating button 100 of reversing switch 98 to cause said switch to deliver current to motor 62 with a polarity to operate in a direction to extend plunger 56 of the actuator, thus lowering tray 72 with container 32 thereon. This downward movement continues to lower the food container to a position within easy reach of the patron, and will continue until wedge 142 of operating bar 132 engages and opens switch 112, at which time the system comes to rest. During the downward movement of tray 72, rod 182 of elevator leg 48 engages and pivots trip arm 148 upwardly to its inoperative position as shown in FIG. 3, where it is secured by the engagement of its pin 152 in latch device 156.

When the patron removes the food container 32 from tray 72, said tray is again tilted upwardly and forwardly, against head 94 of stop bolt 90, by the tension of spring 76. This upward tilting movement of the tray elevates operating bar 132 to disengage wedge 142 from switch 112 to close said switch, and disengages tray arm 102 from operating button 100 of switch 98 to position said switch to deliver current to motor 62 with a polarity to cause operation thereof to retract actuator 52 and raise tray 72. This upward movement continues until the tray is in its normal raised position, at which time wedge 144 opens switch 112 to bring the system to rest. This completes a full cycle of operation.

While I have shown and described a specific embodiment of my invention, it will be readily apparent that many minor changes of structure and operation could be made without departing from the spirit of the invention.

What I claim as new and desire to protect by Letters Patent is:

1. A food delivery system for restaurants comprising:

a. a horizontal elevated conveyor track, b. a carriage operable to move along said track from a central station successively past a plurality of delivery stations spaced along said track, and operable to carry a food container, c. an elevator tray disposed at each of said delivery stations, d. a trip member at each of said delivery stations and operable when set in an operative position to transfer said food container from said carriage to the associated elevator tray as said carriage moves past said delivery station, and having an inoperative position in which it does not transfer said food container, e. trip control means operable to move said trip member between its operative and inoperative positions, f. elevator means at each of said delivery stations and operable to lower the associated elevator tray from a normal raised position in which it receives said food container to a lower delivery position, and to re-elevate it to its normal raised position, and g. elevator control means operable to raise or lower said elevator means.

2. A system as recited in claim 1 wherein said trip control means includes means operable from said central station of said track to move said trip member selectively at any of said delivery stations from its inoperative position to its operative position.

3. A system as recited in claim 1 wherein said trip control means includes mechanical means automatically operable responsively to downward movement of said elevator tray from its normal raised position toward its lowered delivery position to move said trip member from its operative position to its inoperative position.

4. A system as recited in claim 3 wherein said trip control means includes means remotely operable from said central station of said track to move the trip member selectively at any of said delivery stations from its inoperative position to its operative position.

5. A system as recited in claim 1 wherein said carriage includes a conveyor tray operable to support said food container, said conveyor tray passing in closely spaced relation above said elevator trays as said carriage moves along said track, and also beneath the trip members at said delivery stations when said trip members are in their operative positions, said food container extending upwardly from said conveyor tray above the elevation of said trip members when the latter are in their operative positions, whereby if the trip member at any delivery station is in its operative position as said carriage passes said station, said trip member will engage and arrest the horizontal movement of the food container on the conveyor tray in a position directly above the elevator tray of that station, whereupon said food container is swept from said conveyor tray and deposited on the associated elevator tray as movement of said carriage along said track continues.

6. A system as recited in claim 1 wherein said elevator control means includes means operable by the weight of a food container deposited on said elevator tray to actuate said elevator means to lower said elevator tray toward its lowered delivery position, and operable by the removal of said food container from said elevator tray to actuate said elevator means to raise said elevator tray toward its normal raised position.

7. A system as recited in claim 6 wherein said elevator control system additionally includes limit control means operable to arrest downward movement of said elevator means when said elevator tray reaches a predetermined delivery position, and to arrest upward movement of said elevator means when said elevator tray reaches a pre-determined normal raised position.

8. A system as recited in claim 1 including an elevator tray mount which is operable to be raised and lowered by said elevator means, said elevator tray being carried by said tray mount for a small degree of vertical movement relative to said tray mount, and wherein said elevator control means comprises:

a. resilient means biasing said elevator tray upwardly relative to said tray mount to raise said tray so long as said tray does not carry a food container, said tray being lowered relative to its mount by the weight of a food container deposited thereon, and b. mechanically cooperating means carried respectively by said tray and said tray mount and operable responsively to downward movement of said tray relative to its mount to actuate said elevator means to lower said tray mount, and operable by upward movement of said tray relative to its mount to actuate said elevator means to raise said tray mount.

9. A system as recited in claim 8 wherein said elevator means includes and is driven by a reversible electric motor having an operating electric circuit including a reversing switch, and wherein said mechanically cooperating means carried by said tray and tray mount function to control said reversing switch.

10. A system as recited in claim 8 wherein said elevator control means further includes limit control means operable to arrest operation of said elevator means whenever said tray mount reaches a position corresponding either to the normal raised position of said elevator tray, or to the lowered delivery position of said tray.

11. A system as recited in claim 10 with the addition of means operable to deactivate said limit controls responsively either to downward movement of said tray relative to said tray mount when said tray is in its normal raised position, or to the raising of said tray relative to its mount when said tray is in its lowered delivery position.

12. A system as recited in claim 8 wherein said elevator control means comprises:

a. a reversible electric motor operable when driven in respectively opposite directions to raise and lower said elevator tray mount, said motor having an operative electric circuit including a reversing switch and an on-off control switch, said mechanically cooperating members carried by said tray and said tray mount controlling said reversing switch, said control switch being normally closed, and mounted on a stationary portion of the structure, b. a vertical switch control bar connected at its lower end to said elevator tray, and c. upper and lower switch operating members mounted on said control bar and operable respectively to engage and open said control switch whenever said tray mount reaches the lower limit and the upper limit of its travel, downward movement of the tray relative to its mount when said tray is raised, being operable to disengage said lower switch operating member from said control switch to close said switch, and upward movement of said tray relative to its mount, when said tray is in its lowered delivery position, being operable to disengage said upper switch operating member from said control switch to close said switch.

* * * * *